US007546886B2

(12) United States Patent
Benzie et al.

(10) Patent No.: US 7,546,886 B2
(45) Date of Patent: Jun. 16, 2009

(54) METHOD OF CREATING A BOREHOLE IN AN EARTH FORMATION

(75) Inventors: Scott Anthony Benzie, Rijswijk (NL); John Alexander Gordon Dewar, Rijswijk (NL); Andrei Gregory Filippov, Katy, TX (US); Paul Dirk Schilte, Rijswijk (NL)

(73) Assignee: Shell Oil Company, Houston, TX (US)

( * ) Notice: Subject to any disclaimer, the term of this patent is extended or adjusted under 35 U.S.C. 154(b) by 235 days.

(21) Appl. No.: 10/554,066

(22) PCT Filed: Apr. 16, 2004

(86) PCT No.: PCT/EP2004/050544

§ 371 (c)(1),
(2), (4) Date: Aug. 25, 2006

(87) PCT Pub. No.: WO2004/097168

PCT Pub. Date: Nov. 11, 2004

(65) Prior Publication Data

US 2007/0034408 A1 Feb. 15, 2007

(30) Foreign Application Priority Data

Apr. 25, 2003 (EP) ..... 03252654

(51) Int. Cl.
*E21B 7/20* (2006.01)

(52) U.S. Cl. ..... 175/57; 166/380; 166/207; 175/171

(58) Field of Classification Search ..... 166/297, 166/298, 380, 206, 207, 208; 175/57, 171
See application file for complete search history.

(56) References Cited

U.S. PATENT DOCUMENTS 5,271,472 A 12/1993 Leturno ..... 175/107

(Continued)

FOREIGN PATENT DOCUMENTS

| | | |
|---|---|---|
| WO | 99/35368 | 7/1999 |
| WO | 01/86111 | 11/2001 |
| WO | 02/38343 | 5/2002 |
| WO | 03/006788 | 1/2003 |

OTHER PUBLICATIONS

Intl Search Report dated Jul. 27, 2004 (PCT/EP2004/050544).
Intl Preliminary Report on Patentability (PCT/EP2004/050544).
European Patent Search Report dated Sep. 23, 2003.

*Primary Examiner*—Jennifer H Gay
*Assistant Examiner*—David Andrews

(57) ABSTRACT

A method of creating a borehole in an earth formation is provided. The method involves the steps of drilling a section of the borehole and lowering an expandable tubular element into the borehole whereby a lower portion of the tubular element extends into the drilled borehole section, radially expanding the lower portion of the tubular element so as to form a casing in the drilled borehole section, and separating an upper portion of the tubular element from the lower portion so as to allow the separated upper portion to be moved relative to the lower portion.

26 Claims, 11 Drawing Sheets

U.S. PATENT DOCUMENTS

| | | | | |
|---|---|---|---|---|
| 5,291,956 | A | 3/1994 | Mueller et al. | 175/67 |
| 6,742,606 | B2 | 6/2004 | Metcalfe et al. | 175/57 |
| 7,004,264 | B2 | 2/2006 | Simpson et al. | 175/57 |
| 7,178,601 | B2 | 2/2007 | Burge | 166/380 |
| 2001/0045284 | A1 | 11/2001 | Simpson et al. | 166/313 |
| 2003/0056991 | A1 | 3/2003 | Hahn et al. | 175/61 |

METHOD OF CREATING A BOREHOLE IN AN EARTH FORMATION

PRIORITY CLAIM

The present application claims priority on European Patent Application 03252654.3 filed Apr. 25, 2003.

FIELD OF THE INVENTION

The present invention relates to a method of creating a borehole in an earth formation.

BACKGROUND OF THE INVENTION

In the production of hydrocarbon fluid from an earth formation, boreholes are drilled to provide a conduit for hydrocarbon fluid flowing from a reservoir zone to a production facility to surface. In conventional drilling operations the borehole is provided with tubular casing of predetermined length at selected intervals of drilling. Such procedure leads to the conventional nested arrangement of casings whereby the available diameter for the production of hydrocarbon fluid becomes smaller with depth in stepwise fashion. This stepwise reduction in diameter can lead to technical or economical problems, especially for deep wells where a relatively large number of separate casings is to be installed.

To overcome the drawback of a nested casing scheme it has already been proposed to use a casing scheme whereby individual casings are radially expanded after installation in the borehole.

WO 99/35368 discloses a method whereby casings of predetermined length are installed and expanded in the borehole. After installing and expanding each casing, the borehole is deepened further using a suitable drill string, whereafter the drill string is removed from the borehole. A next casing is lowered through the expanded previous casing section and subsequently expanded in the newly drilled borehole portion, etcetera.

SUMMARY OF THE INVENTION

The present inventions include a method of creating a borehole in an earth formation, the method comprising the steps of:

a) drilling a section of the borehole and lowering an expandable tubular element into the borehole whereby a lower portion of the tubular element extends into the drilled borehole section;

b) radially expanding said lower portion of the tubular element so as to form a casing in the drilled borehole section; and c) separating an upper portion of the tubular element from said lower portion so as to allow the separated upper portion to be moved relative to said lower portion.

To create an overlapping casing arrangement, suitably in each step c) said upper portion is separated from said lower portion at a position where the tubular element extends into the previous casing arranged in the borehole. It is preferred that said previous casing has a lower end part of enlarged inner diameter relative to the remainder of the previous casing, and wherein said upper tubular element portion is separated from said lower tubular element portion at a position within said lower end part of the previous casing.

Suitably, in each step c) said upper portion is separated from said lower portion by cutting the tubular element.

Adequately the tubular element is cut at a location where the tubular element is substantially unexpanded.

Suitably, in the last step d) said upper portion is expanded against the previously installed casings. It is thus achieved that two layers of tubular protect the flow conduit from the formation.

The present inventions include a drilling assembly for use in the method of the invention, the drilling assembly being of a size allowing the assembly to be moved through the tubular element when unexpanded, the drilling assembly comprising a drill bit, a downhole motor arranged to drive the drill bit, and movement means for moving the drilling assembly through the tubular element.

The present inventions include an expansion assembly for use in the method of the invention, the expansion assembly being operable between a radially expanded mode in which the expansion assembly is of a diameter larger than the inner diameter of the tubular element when unexpanded, and a radially retracted mode in which the expansion assembly is of a diameter smaller than the inner diameter of the tubular element when unexpanded, and wherein the expansion assembly comprises actuating means for actuating the expansion assembly between the radially expanded mode and the radially refracted mode thereof.

BRIEF DESCRIPTION OF THE DRAWINGS

The invention will be described hereinafter by way of example in more detail with reference to the accompanying drawings, in which.

DETAILED DESCRIPTION OF THE INVENTION

Figure 1:
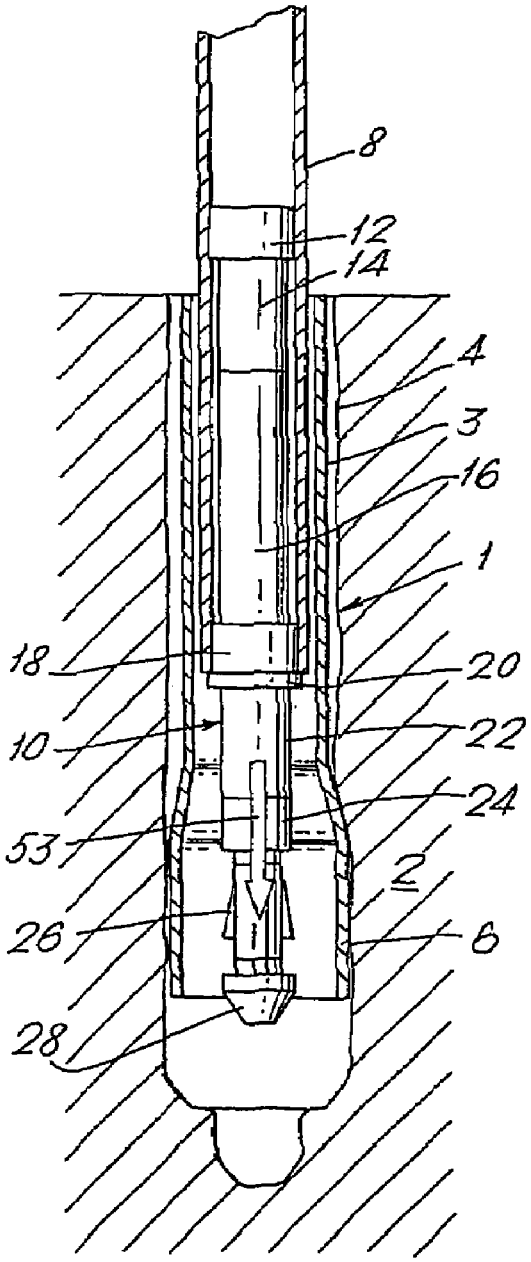
FIG. 1 schematically shows a drilling assembly used in an embodiment of the method of the invention.

In the Figures, like reference numbers relate to like components.

In the description below the terms "casing" and "liner" are used without implied distinction between such terms, whereby both terms generally refer to tubular elements used in wellbores for strengthening and/or sealing same.

Referring to FIGS. 1-5 there is shown a borehole 1 formed in an earth formation 2 during various stages of drilling of a section of the borehole 1. A steel surface casing 3 is fixedly arranged in an upper section 4 of the borehole 1, the surface casing 3 having a lower end part 6 (hereinafter referred to as "the bell 6") of inner diameter slightly smaller than D1+2*t, wherein the meaning of D1 and t are explained hereinafter. A steel expandable tubular element 8 of outer diameter smaller than the inner diameter of said remaining part of the casing 3, extends into the surface casing 3.

A drilling assembly 10 is arranged in the tubular element 8 at the lower end thereof such that part of the drilling assembly 10 extends below the tubular element 8. The drilling assembly 10 includes successively in downward direction:

- a radially expandable top packer 12 for sealing the drilling assembly 10 relative to the casing 3,
- a MWD/LWD (measurement while drilling/logging while drilling) package 11,
- a hydraulic motor 16 operable by drilling fluid,
- a radially expandable anchor 18 for anchoring the drilling assembly 10 in the tubular element 8,
- a casing locator 20 for detecting the lower end of the tubular element 8,
- a steering device 22 for steering the drilling assembly 10 in the borehole 1,
- a logging sensor unit 24 for logging while drilling,
- a radially expandable underreamer drill bit 26 arranged to be driven by the motor 16, and suitable to drill the borehole 1 to a diameter larger than the outer diameter of the tubular element 8 after expansion thereof, and
- a pilot drill bit 28 arranged to be driven by the motor 16.

The order of the various assembly elements can be different from the order described above.

Figure 4:
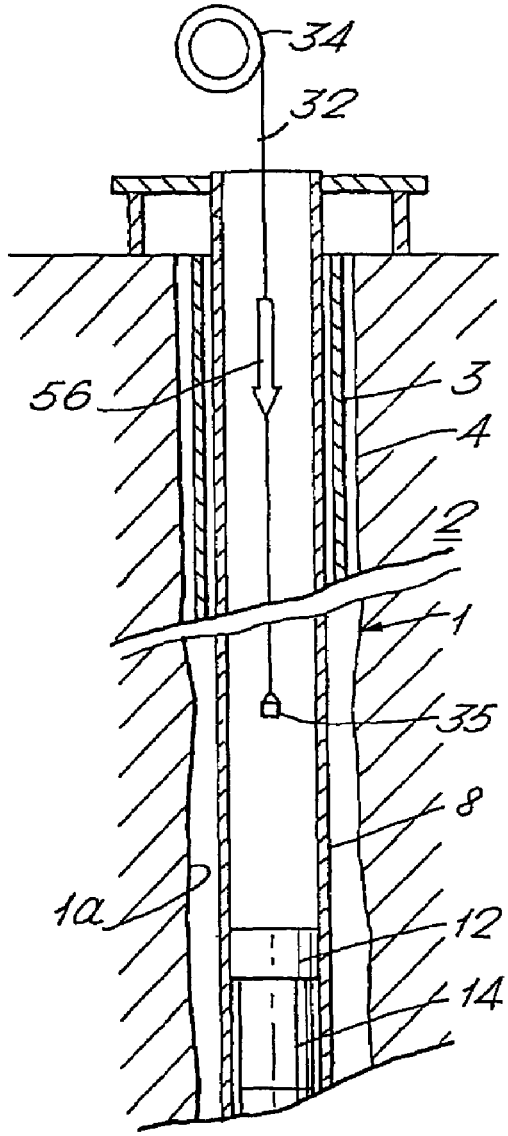
FIG. 4 schematically shows the drilling assembly of FIG. 1 before retrieval thereof to surface following drilling of the borehole section.
Figure 5:
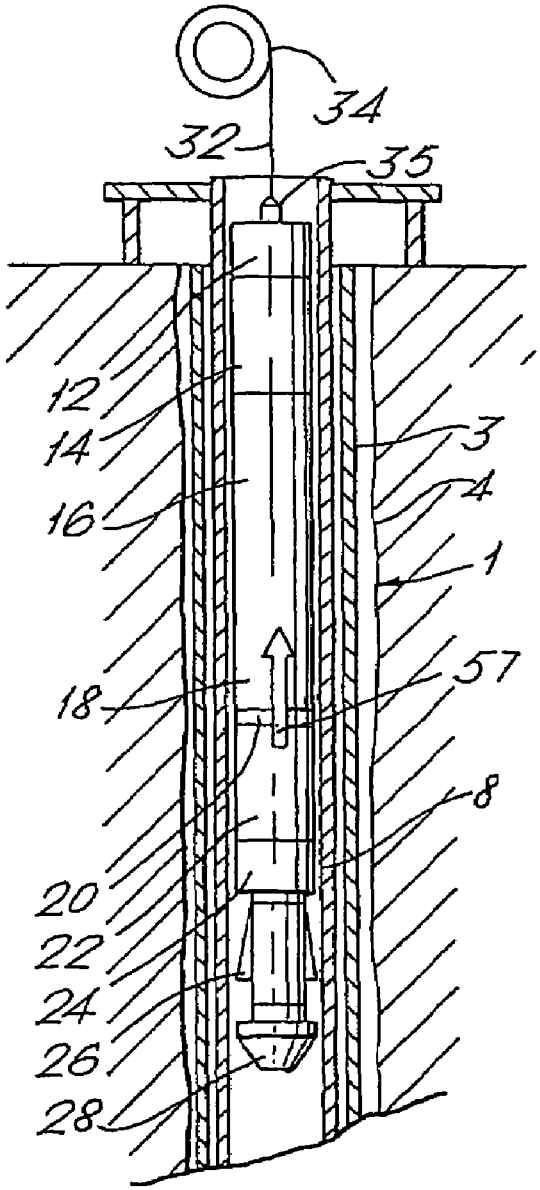
FIG. 5 schematically shows the drilling assembly of FIG. 1 during retrieval thereof to surface following drilling of the borehole section.

At the stages of FIGS. 4 and 5 a wireline 32 extends from a winch 34 at surface through the tubular element 8, the wireline 32 being at the lower end thereof provided with a connection member 35. The upper end of the drilling assembly 10 is provided with a corresponding connection member (not shown) into which the connection member 35 of the wireline can be latched so as to connect the wireline 32 to the drilling assembly 10. The wireline 32 is provided with an electric conductor (not shown) connected to an electric power source (not shown) at surface. The top packer 12 and the anchor 18 are operable by electric power provided through the electric conductor when the wireline 32 is connected to the drilling assembly 10. Referring to FIGS. 6-12 there is shown the borehole 1 during various stages of forming a casing in the borehole. An expansion assembly 36 extends into tubular element 8 and is suspended on the wireline 32 (or a similar wireline) by connection member 35 latched into a connection member (not shown) of the expansion assembly 36. The expansion assembly 36 includes successively in downward direction:

- a cutter 38 for cutting the tubular element 8,
- an electric motor 40,
- a fluid pump 42 arranged to be driven by the electric motor 40,
- a casing locator 44 for detecting the lower end of the tubular element 8,
- an upper conical expander 46 operable between a radially expanded mode in which expander 46 has a first outer diameter D1 larger than the inner diameter of the tubular element 8 when unexpanded, and a radially retracted mode in which expander 46 is of outer diameter smaller than the inner diameter of the tubular element 8 when unexpanded, whereby the expander 46 is provided with a primary hydraulic drive system (not shown) for actuation of the expander 46 between said modes, the primary hydraulic drive system being arranged to be selectively driven by fluid pump 42,
- a lower conical expander 48 operable between a radially expanded mode in which expander 48 has a second outer diameter D2 larger than said first outer diameter D1, and a radially retracted mode in which expander 48 is of outer diameter smaller than the inner diameter of the tubular element 8 when unexpanded, whereby the expander 48 is provided with a secondary hydraulic drive system (not shown) for actuation of the expander 48 between said modes, the secondary hydraulic drive system being arranged to be selectively driven by fluid pump 42.

The cutter 38 and the electric motor 49 are operable by electric power provided through the electric conductor in the wireline 32.

The order of the various assembly elements can be different from the order described above.

The diameters D1 and D2 are selected such that D2 is slightly smaller than D1+2*t wherein t denotes the wall thickness of tubular element B.

Figure 11:
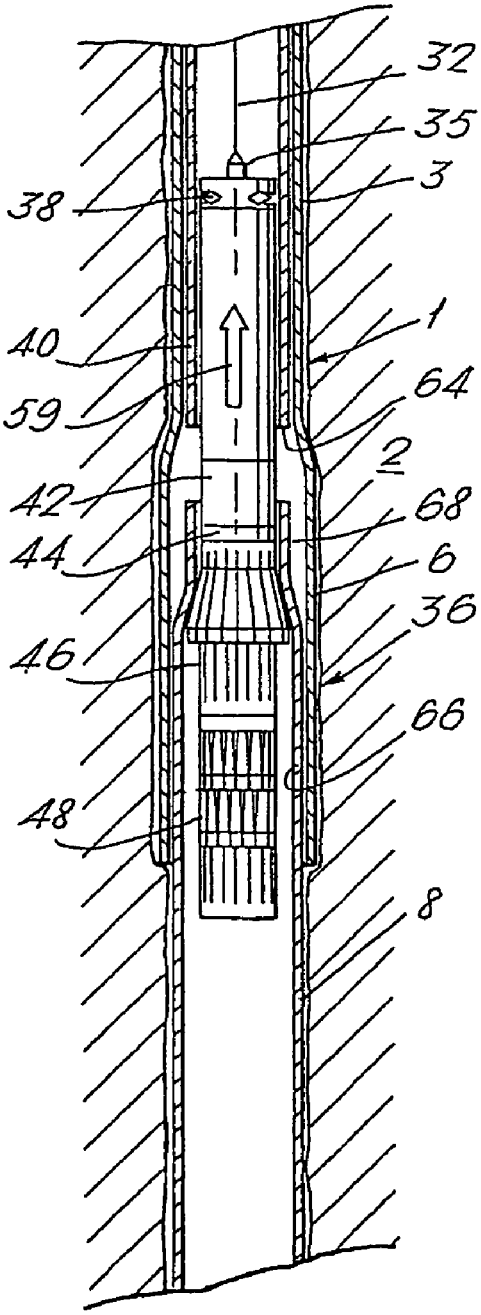
FIG. 11 schematically shows the expansion assembly of FIG. 6 during expansion of the upper end part of the lower portion of the tubular element.
Figure 12:
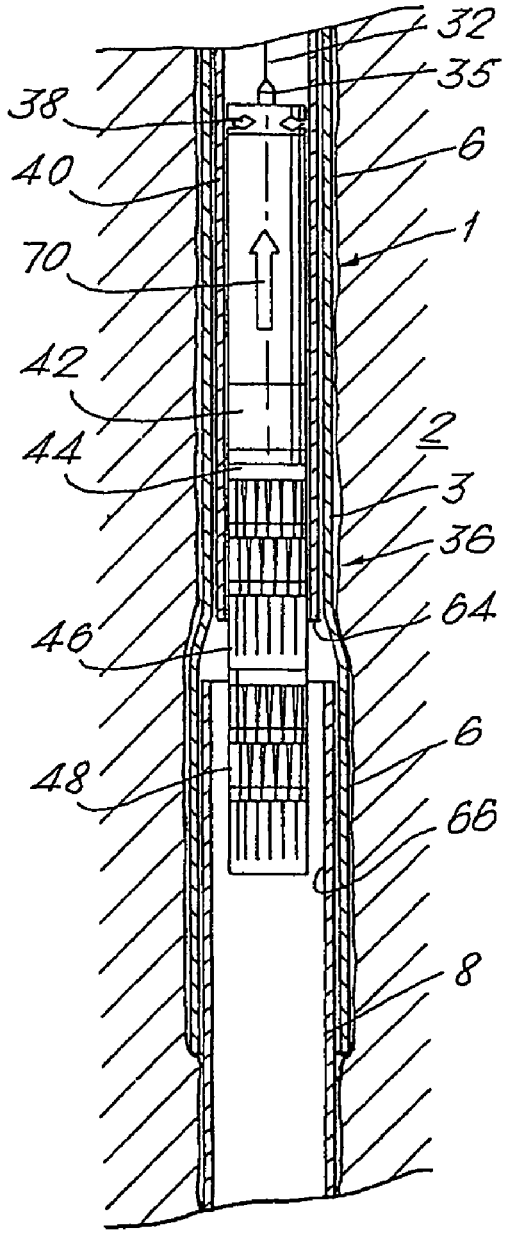
FIG. 12 schematically shows the expansion assembly of FIG. 6 during retrieval thereof through the separated upper portion, to surface.

At the stages shown in FIGS. 11 and 12 the tubular element is separated into an upper tubular element portion 50 and a lower tubular element portion 52.

Referring to FIGS. 13-18 there is shown the borehole 1 during various stages of drilling of a subsequent section of the borehole 1.

During normal operation the drilling assembly 10 is inserted into the tubular element 8 at the lower end thereof, whereby the underreamer drill bit 26 and the pilot drill bit protrude below the tubular element 8. The anchor 18 is brought into the expanded state thereof so that the drilling assembly 10 becomes firmly anchored in the tubular element 8, and the top packer 12 is brought in the expanded state thereof so that the drilling assembly 10 becomes sealed relative the tubular element 8. The tubular element 8 with the drilling assembly 10 anchored thereto is then lowered (in direction of arrow 53) into the initial upper borehole section 4, through surface casing 3 (FIG. 1).

Figure 2:
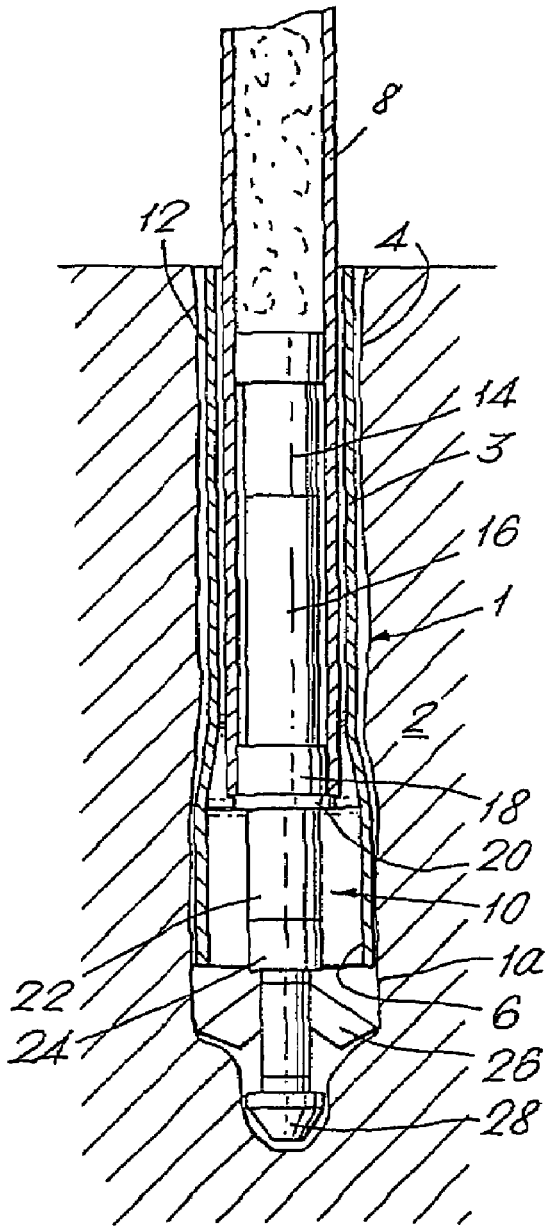
FIG. 2 schematically shows the drilling assembly of FIG. 1 during a drilling stage.

Lowering of the combined tubular element 8 and drilling assembly 10 proceeds until the pilot drill bit 28 reaches the borehole bottom, whereafter the underreamer drill bit 26 is expanded. Drilling of a section 1*a* of the borehole 1 below the initial upper section 4 is then started by pumping a stream of drilling fluid 54 from a pump (not shown) at surface through the tubular element 8 to the drilling assembly 10 so that the hydraulic motor 16 is thereby operated to rotate the pilot drill bit 28 and the underreamer drill bit 26. As a result the borehole section 1*a* is drilled, whereby the rock cuttings are transported to surface by the return flow of stream flowing upwardly between the tubular element 8 and the surface casing 3 (FIG. 2).

Figure 3:
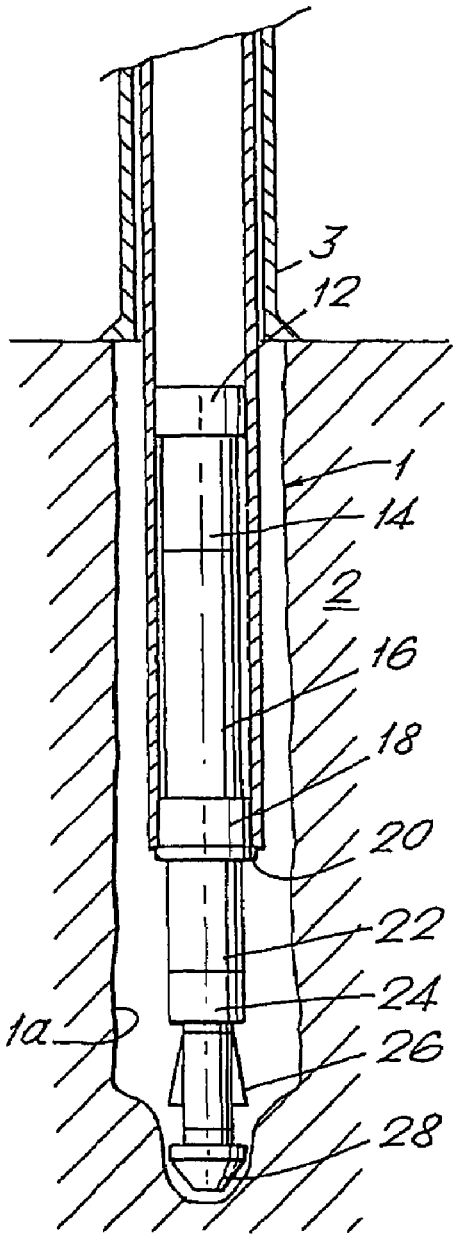
FIG. 3 schematically shows the drilling assembly of FIG. 1 after drilling of a borehole section.

Drilling of the borehole section 1*a* proceeds until it is required to case the newly drilled borehole section 1*a*. Such requirement can relate to circumstances dictating setting of casing, such circumstances for example being the occurrence drilling fluid losses into the formation or the occurrence of swelling shale encountered during drilling. A lower end part of borehole section 1*a* is drilled to an enlarged diameter by further expanding the underreamer drill bit 26. Pumping of drilling fluid is then stopped to stop drilling, and the underreamer drill bit 26 is retracted to the retracted position thereof (FIG. 3).

Next the wireline 32 is lowered (in direction of arrow 56) by winch 34 until the connection member 35 latches into the connection member of the drilling assembly 10 (FIG. 4), and the anchor 18 and the top packer 12 are retracted to their respective radially retracted positions.

Subsequently the drilling assembly 10 is retrieved (in direction of arrow 57) through the tubular element 8 to surface by operation of the winch 34 (FIG. 5), and the wireline 32 is disconnected from the drilling assembly 10 at surface.

Figure 6:
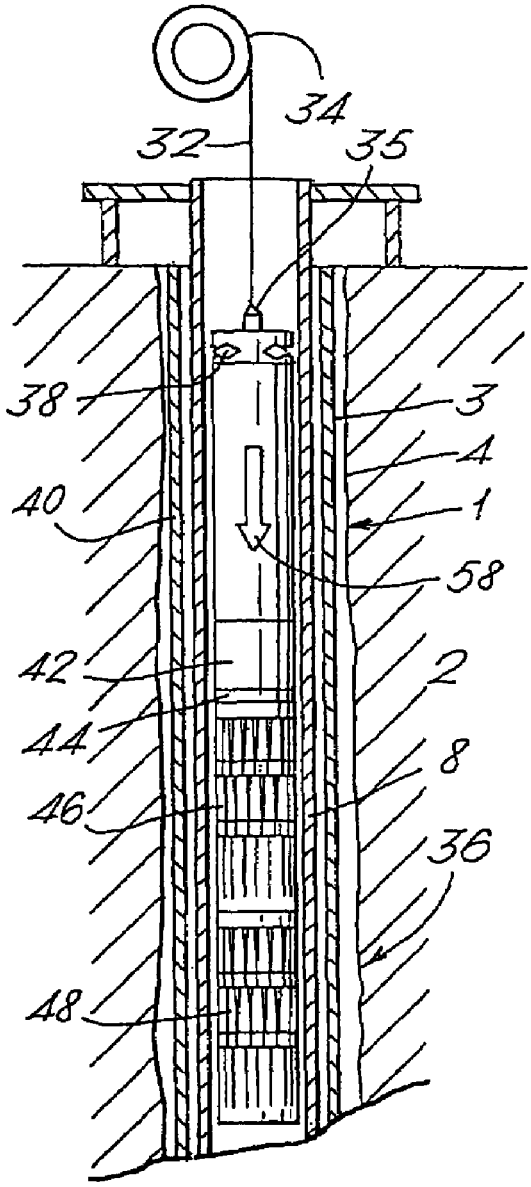
FIG. 6 schematically shows an expansion assembly used in an embodiment of the method of the invention, during lowering thereof into the borehole.

The wireline 32 (or another similar wireline) is then connected to the expansion assembly 36 by latching connection member 35 into the connection recess of the expansion assembly 36. The upper and lower expanders 46, 48 are brought to their respective radially retracted modes, and then the expansion assembly 36 is lowered (in direction of arrow 58) through the tubular element 8 (FIG. 6).

Figure 7:
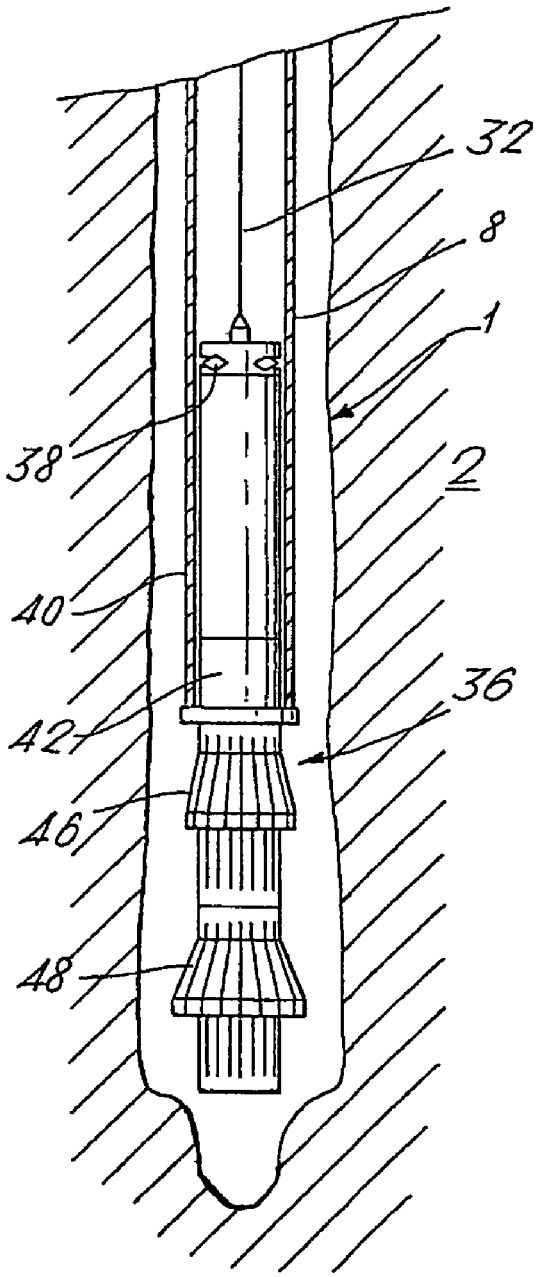
FIG. 7 schematically shows the expansion assembly of FIG. 6 in a position before start of the expansion process.

Lowering of the expansion assembly 36 is stopped when the expansion assembly 36 is at a position at the lower end of the tubular element 8, whereby the expanders 46, 48 extend below the tubular element 8 (FIG. 7).

Figure 8:
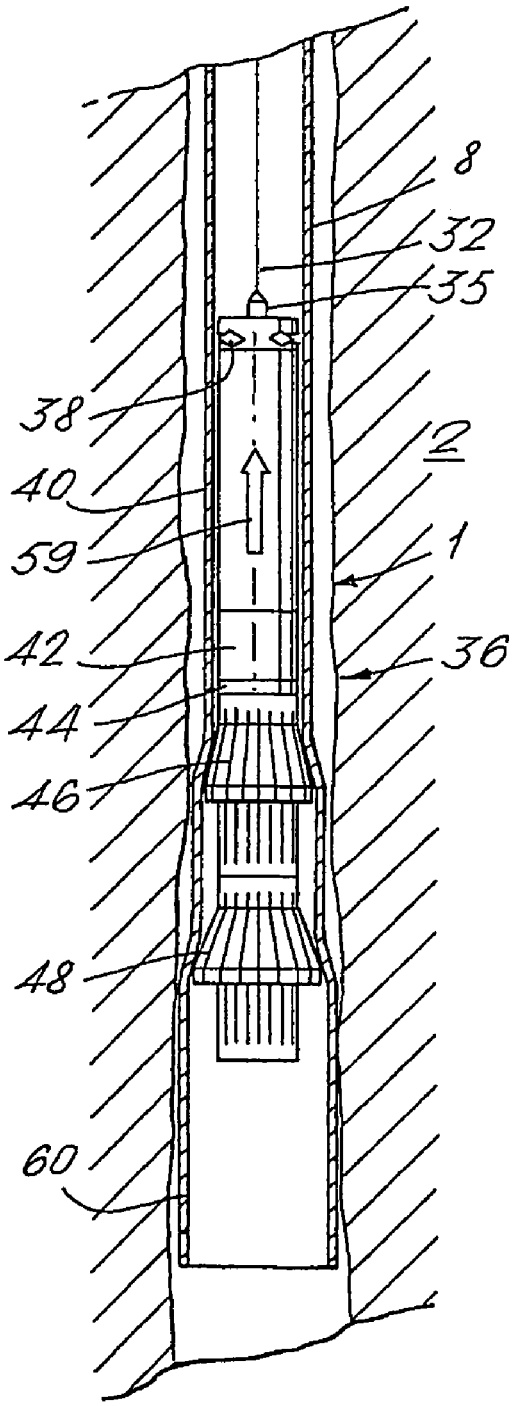
FIG. 8 schematically shows the expansion assembly of FIG. 6 during an initial stage of the expansion process.

The electric motor 40 is then operated by electric power provided through the electric conductor in wireline 32 so as to drive the fluid pump 42. Initially both the primary and the secondary hydraulic drive systems are selected to be driven by the pump 42 so that, as a result, said hydraulic drive systems induce the respective expanders 46, 48 to move between their respective expanded and retracted modes in alternating fashion. Simultaneously a moderate tensional force is applied to the wireline 32 so that, during each cycle that both expanders 46, 48 are in their respective retracted modes, the expansion assembly 36 progresses incrementally through the tubular element 8 (in direction of arrow 59). Further, the expander 46 expands the tubular element 8 to inner diameter D1 and the expander 48 expands the tubular element 8 to inner diameter D2 during each cycle that the expanders 46, 48 move from their respective radially retracted mode to their radially expanded mode (FIG. 8).

Figure 9:
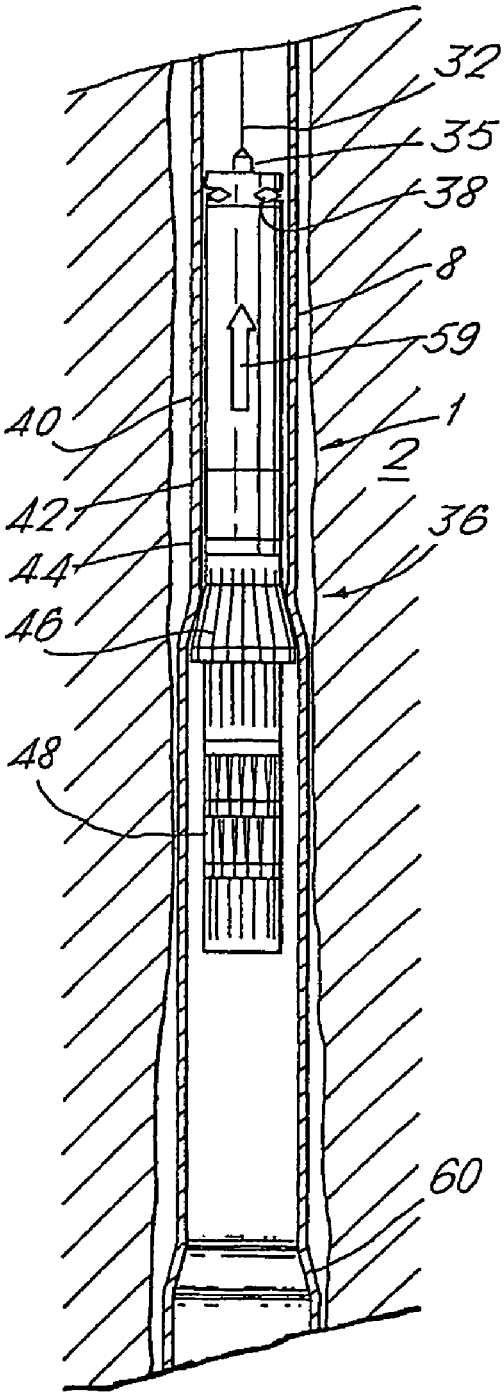
FIG. 9 schematically shows the expansion assembly of FIG. 6 during a subsequent stage of the expansion process.

The secondary hydraulic drive system is turned off as soon as a selected length of tubular element 8 has been expanded to inner diameter D2, so that the lower expander 48 remains in the retracted mode and the expansion process proceeds by operation of upper expander 46 operating only. As a result, a lower end part 60 (hereinafter referred to as "the bell 60") of tubular element 8 is expanded to inner diameter D2 and the remainder of tubular element 8 is expanded to inner diameter D1 (FIG. 9). As will be described hereinafter, the function of the bell 60 is to provide overlap with a tubular element portion deeper in the borehole. Thus the length of the bell 60 is to be selected with requirements relating to such overlap, for example relating to sealing requirements for overlapping tubular element portions.

Figure 10:
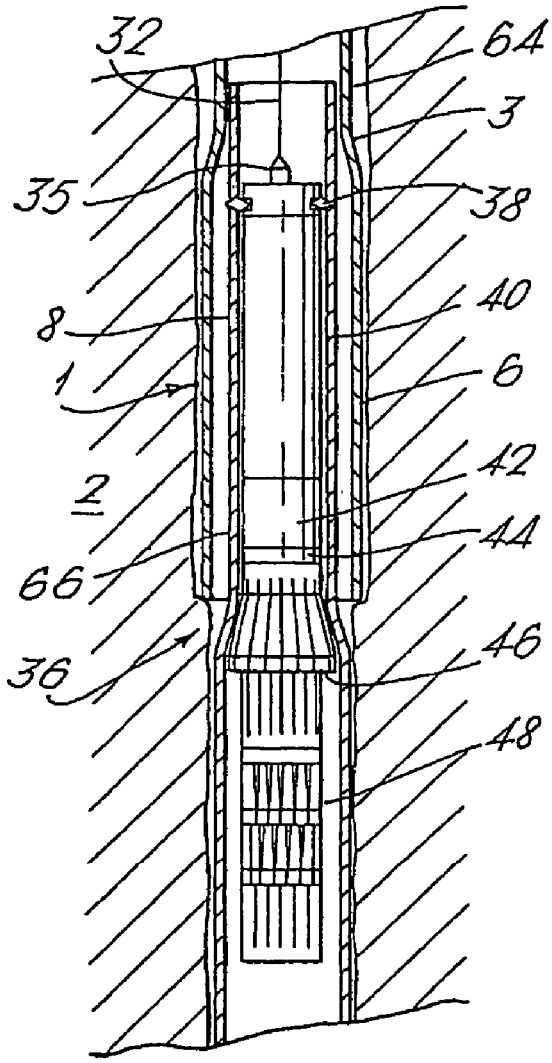
FIG. 10 schematically shows the expansion assembly of FIG. 6 during cutting of the tubular element to separate an upper portion thereof.

The expansion process is stopped when the cutter 38 becomes positioned near the upper end of the bell 6 of surface casing 3. In a next step, the cutter 38 is operated to cut the tubular element 8 so as to separate the tubular element 8 into an upper portion 64 and a lower portion 66 (FIG. 10).

Since the cutter 38 is arranged upwardly from the expander 46, the lower tubular element portion 66 has an unexpanded upper end part 68. After cutting tubular element 8 is finalized, operation of the upper expander 46 is resumed so as to expand the remaining unexpanded upper portion 68. Since the bell 6 of surface casing 3 has an inner diameter slightly smaller than D1+2*t, the upper end part 68 of tubular element 8 will be expanded tightly against the bell 6 so as to form a metal-to-metal seal. Optionally an annular seal element (not shown) can be arranged between tubular element 8 and bell 6 to provide additional sealing functionality. Such seal element can be made, for example, of elastomeric material or ductile metal (FIG. 11).

When expansion of lower tubular element portion 66 is complete the upper expander 46 is brought to the radially retracted mode thereof, and the expansion assembly 36 is retrieved to surface (in direction of arrow 70) by means of wireline 32 and winch 34 (FIG. 12).

Figure 13:
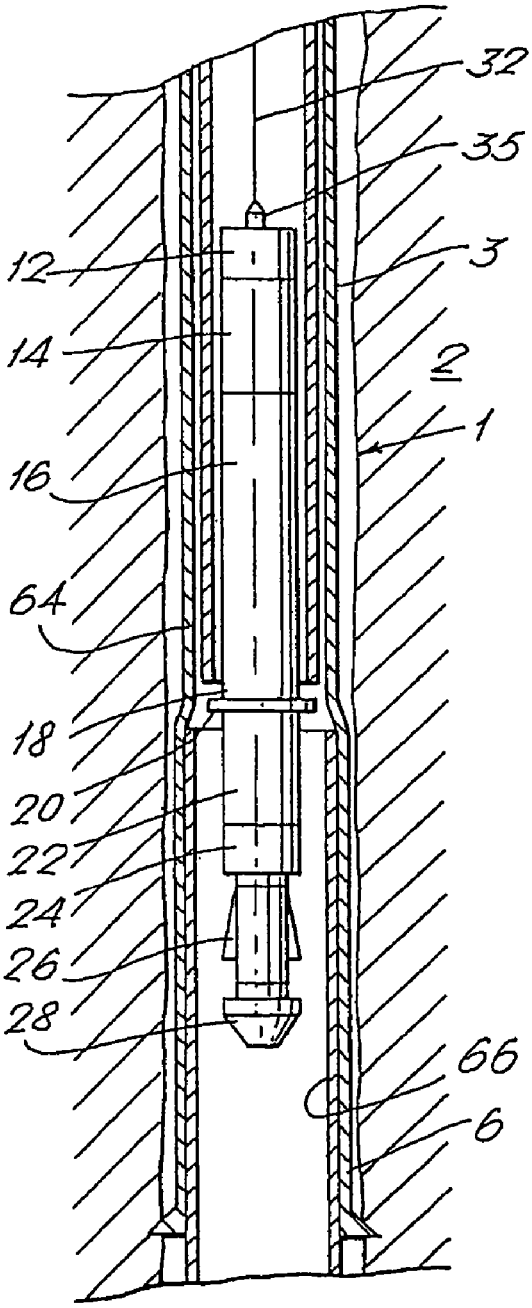
FIG. 13 schematically shows the drilling assembly of FIG. 1 before anchoring thereof to the separated upper portion of the tubular element.
Figure 14:
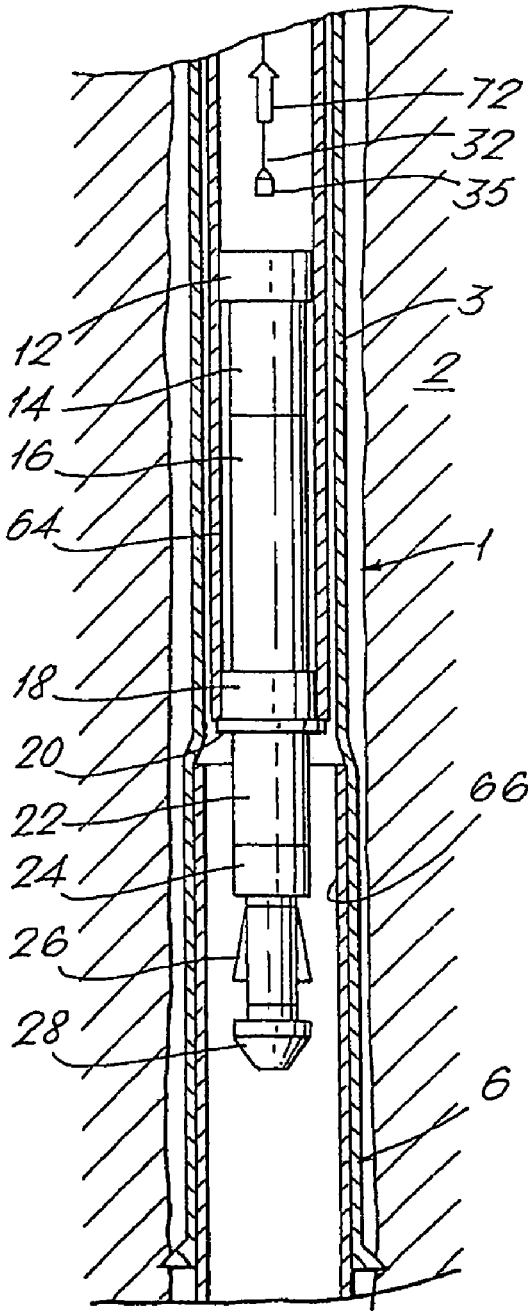
FIG. 14 schematically shows the drilling assembly of FIG. 1 after anchoring thereof to the separated upper portion of the tubular element.

In a next step the drilling assembly 10 (or similar drilling assembly) is lowered on wireline 32 (or similar wireline) through the upper portion 64 of tubular element 8, whereby the top packer 12, the anchor 8 and the underreamer drill bit 26 are in their respective radially retracted positions. Lowering is stopped when the underreamer drill bit 26 and the pilot drill bit 28 protrude below the lower end of tubular element portion 64 (FIG. 13). In this position of the drilling assembly 10, the top packer 12 and the anchor 18 are expanded to their respective radially expanded states so that the drilling assembly 10 becomes anchored and sealed to the tubular element portion 64. The connection member 35 is then unlatched from the drilling assembly 36 by activating an electric release (not shown) and the wireline 32 is retrieved to surface (in direction of arrow 72) (FIG. 14).

Figure 15:
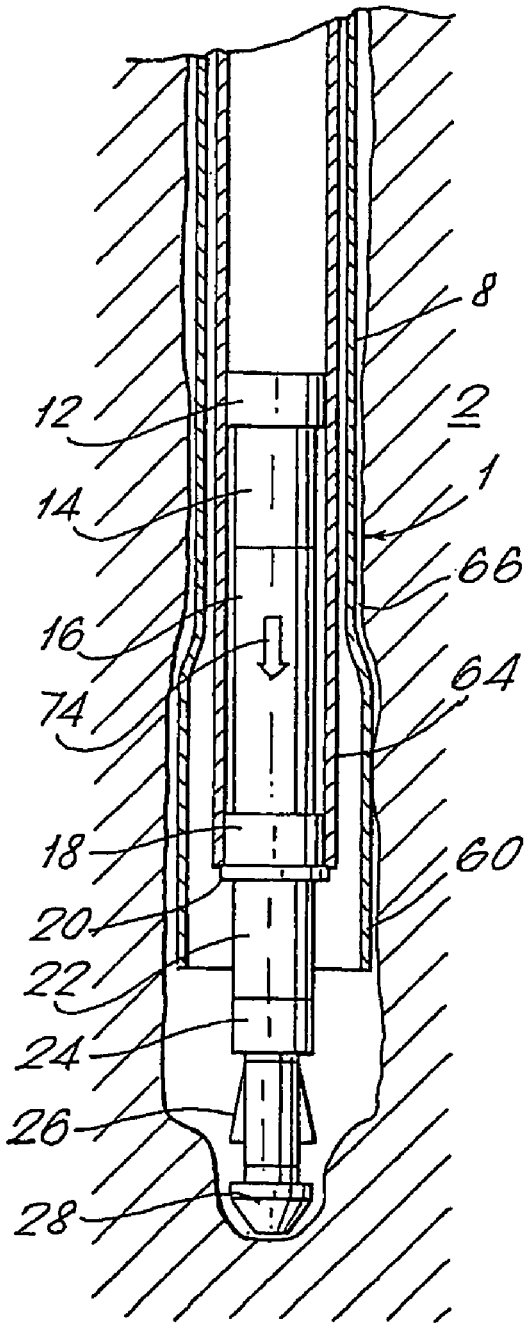
FIG. 15 schematically shows the drilling assembly of FIG. 1 at the start of drilling a subsequent borehole section.
Figure 16:
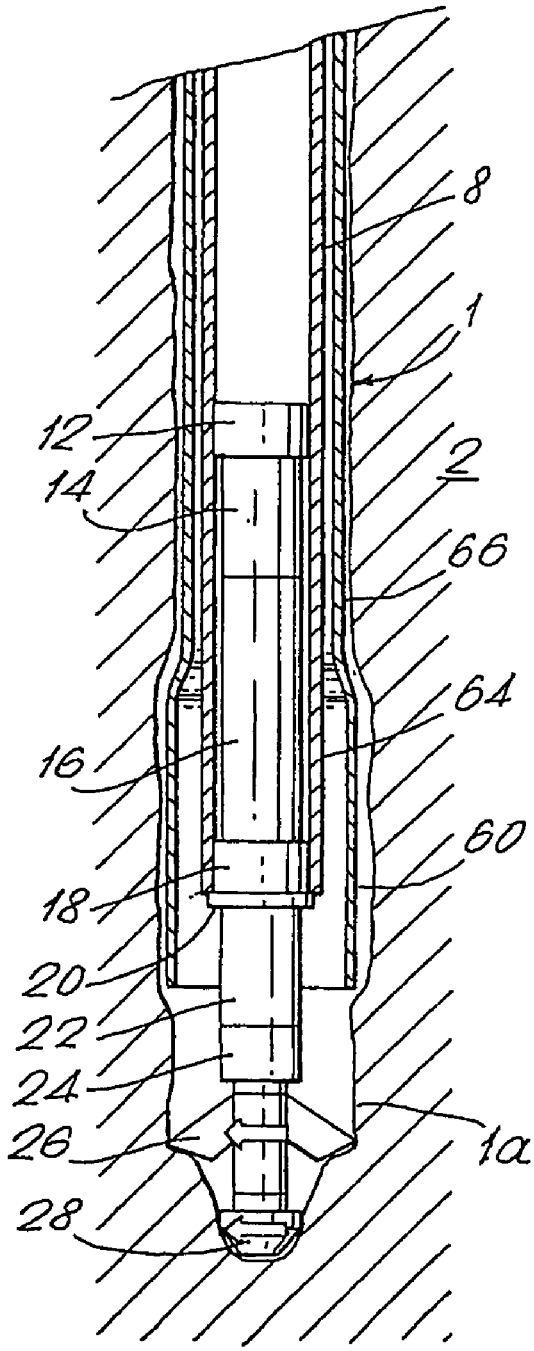
FIG. 16 schematically shows the drilling assembly of FIG. 1 during drilling of the subsequent borehole section.

Subsequently, the tubular element portion 64 with the drilling assembly anchored thereto is lowered (in direction of arrow 74) through the expanded tubular element portion 66 until the pilot drill bit 28 reaches the borehole bottom (FIG. 15). The underreamer drill bit 26 is expanded, and drilling of a subsequent borehole section 1*b* below borehole section 1*a* is then started by pumping a stream of drilling fluid 76 through the tubular element portion 64 to the drilling assembly 10 so that the hydraulic motor 16 is operated to rotate the pilot drill bit 28 and the underreamer drill bit 26. As a result, the borehole section 1*b* is drilled, whereby the rock cuttings are transported to surface by the return flow of stream 54 flowing upwardly between the tubular element portion 64 and the expanded tubular element portion 66 (FIG. 16).

Figure 17:
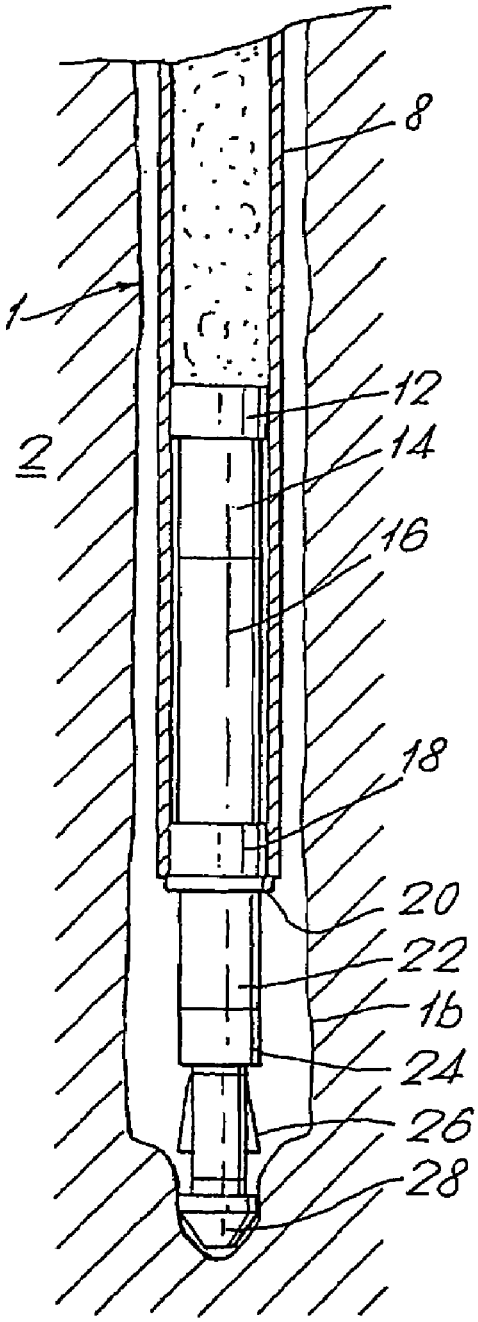
FIG. 17 schematically shows the drilling assembly of FIG. 1 before retrieval thereof to surface following drilling of the subsequent borehole section.

Drilling of the borehole section 1*b* proceeds until it is required to case the newly drilled borehole section 1*b*, for example due to the occurrence of drilling fluid losses into the formation or swelling shale. Pumping of drilling fluid is then stopped to stop drilling, and the underreamer drill bit 26 is retracted to the retracted position thereof (FIG. 17).

Next the wireline 32 is lowered by winch 34 until the connection member 35 latches into the connection recess of the drilling assembly 10, whereafter the anchor 18 and the top packer 12 are retracted to their respective radially retracted states.

Figure 18:
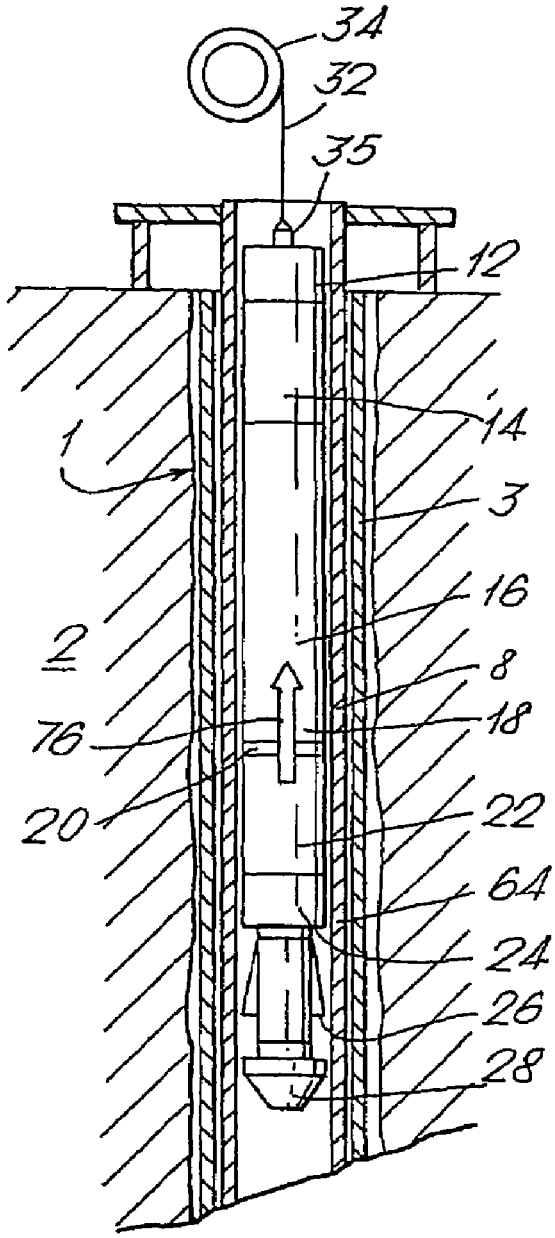
FIG. 18 schematically shows the drilling assembly of FIG. 1 during retrieval thereof to surface following drilling of the subsequent borehole section.

Subsequently the drilling assembly 10 is retrieved to surface (in direction of arrow 76) through the tubular element portion 64 by operation of the winch 34 (FIG. 18). The procedure described above is then repeated, starting from the step of lowering the expansion assembly 36 through the tubular element portion 64, until the desired borehole depth is reached.

In repeating the above described steps, for ease of reference each borehole section drilled is defined as a section of the borehole subsequent to the borehole section drilled in the preceding drilling step, and the tubular element is defined to be the upper portion of the tubular element as separated in the preceding step of cutting the tubular element.

Figure 19:
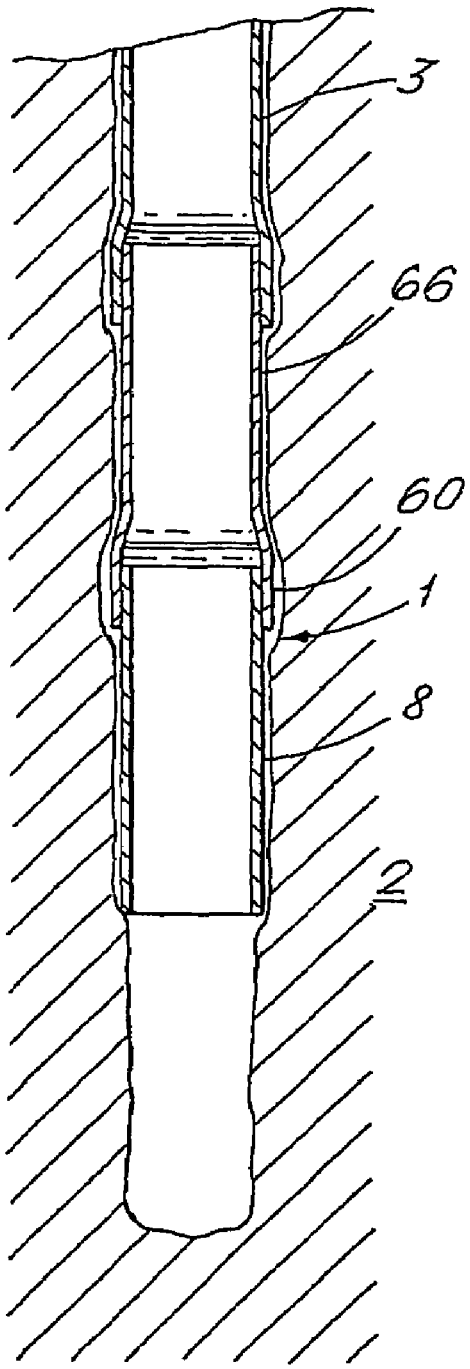
FIG. 19 schematically shows a borehole after drilling of the borehole as shown in FIGS. 1-18.
Figure 20:
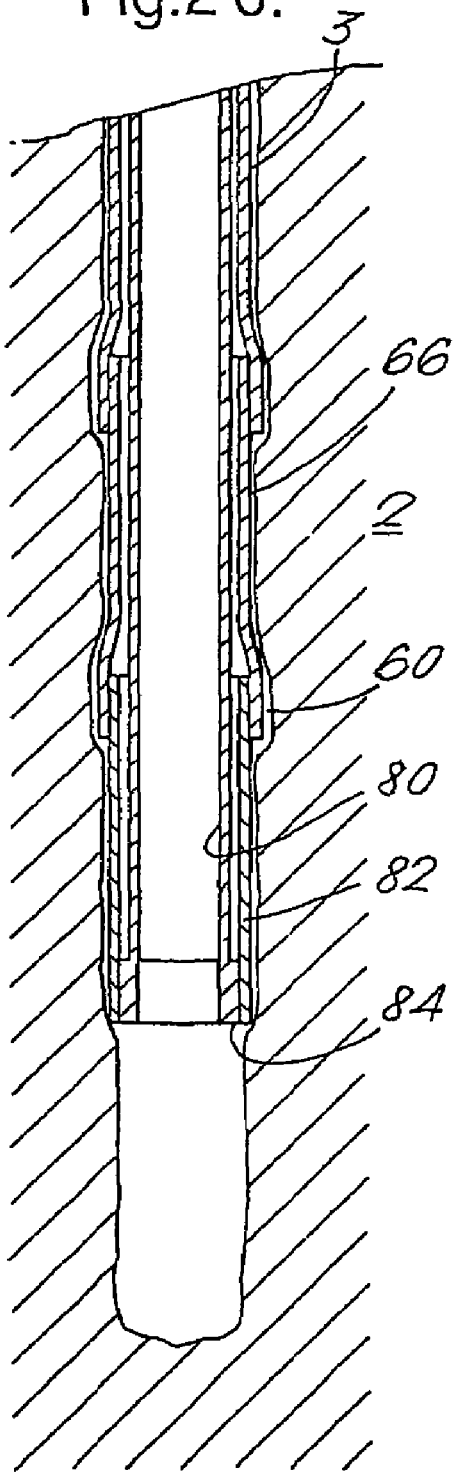
FIG. 20 schematically shows a first possible completion after drilling of the borehole as shown in FIGS. 1-18.

The final borehole section is drilled into a hydrocarbon fluid reservoir zone of the earth formation, which concludes the drilling phase. At this stage, the tubular element portion 64 can be retrieved from the borehole to allow installing of a conventional completion (not shown) (FIG. 19).

The term "unexpanded portion" of the tubular element is intended to refer to a portion of the tubular element which is to be expanded to a larger diameter. Thus it is to be understood that such "unexpanded portion" can be a portion which has not yet been subjected to expansion before or to a portion which has already been subjected to expansion.

With the expander system of the invention it is achieved that the expander may no longer need to be accurately repositioned after each expansion cycle. By simply exerting an axial force of moderate magnitude to the expander (when in the retracted mode) in the direction in which expansion of the tubular element is progressing, the expander moves forward until the contact section contacts the inner surface of the tubular element. The expander thereby becomes automatically repositioned to perform the next expansion cycle.

Such axial force of moderate magnitude is suitably provided by the weight of the expander, by a pulling string connected to the expander, or by any other suitable means connected to the expander, such as a tractor, a weight element or a drill string. Also drag from a fluid stream passing along the expander, or jet-action from a stream of fluid jetted from the expander during movement to the retracted mode thereof, can provide sufficient force to move the expander forward.

Preferably the expander includes an expansion surface extending in axial direction and being operable to move radially outward so as to expand the tubular element during movement of the expander from the retracted mode to the expanded mode thereof, said expansion surface being of varying diameter in axial direction.

Suitably the contact section has an outer surface coinciding with the expansion surface.

The diameter of the expansion surface preferably increases continuously in axial direction. For example, the expansion surface can be a tapering surface, a frustoconical surface, a convex surface, or a stepwise tapered or convex surface.

To ensure that the tubular element is expanded in a uniform manner it is preferred that the expansion surface is arranged to move radially outward in substantially uniform manner along the length thereof during movement of the expander from the retracted node to the expanded mode thereof.

In a preferred embodiment the expander comprises an expander body including a plurality of body segments spaced along the circumference of the expander body, each segment extending in longitudinal direction of the expander and being movable between a radially retracted position and a radially expanded position.

The expander body is suitable provided with a plurality of longitudinal slots spaced along the circumference of the expander body, each said slot extending between a pair of adjacent body segments. Each body segment is, for example, at both ends thereof integrally formed with the expander body.

The expander body is preferably a tubular expander body, and the actuating means includes an inflatable member arranged within the tubular expander body so as to move each body segment radially outward upon inflation of the inflatable member.

Figure 21:
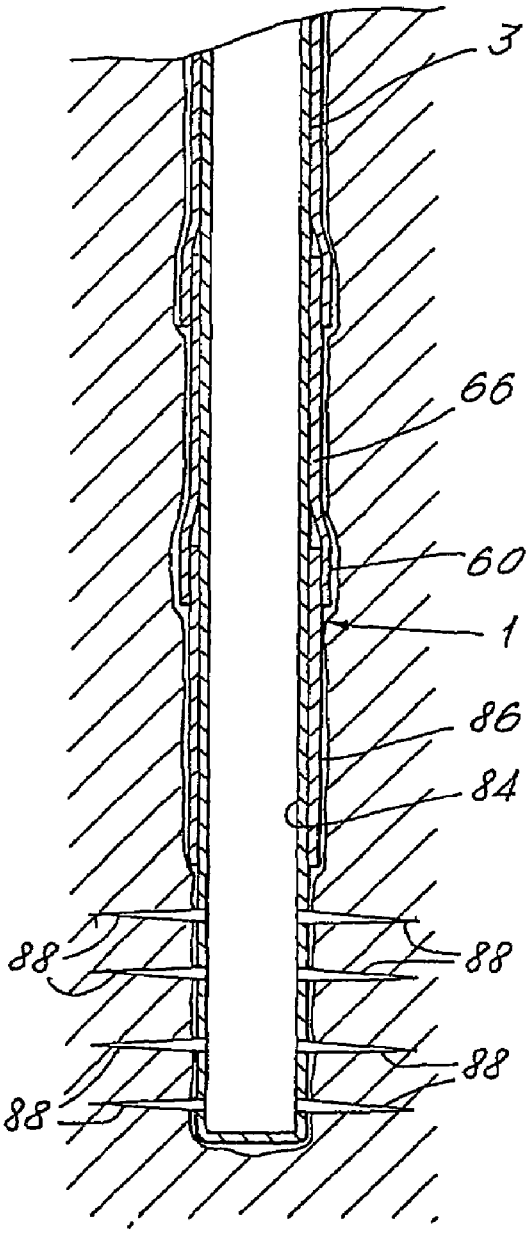
FIG. 21 schematically shows a second possible completion of the borehole after drilling of the borehole as shown in FIGS. 1-18.
Figure 22:
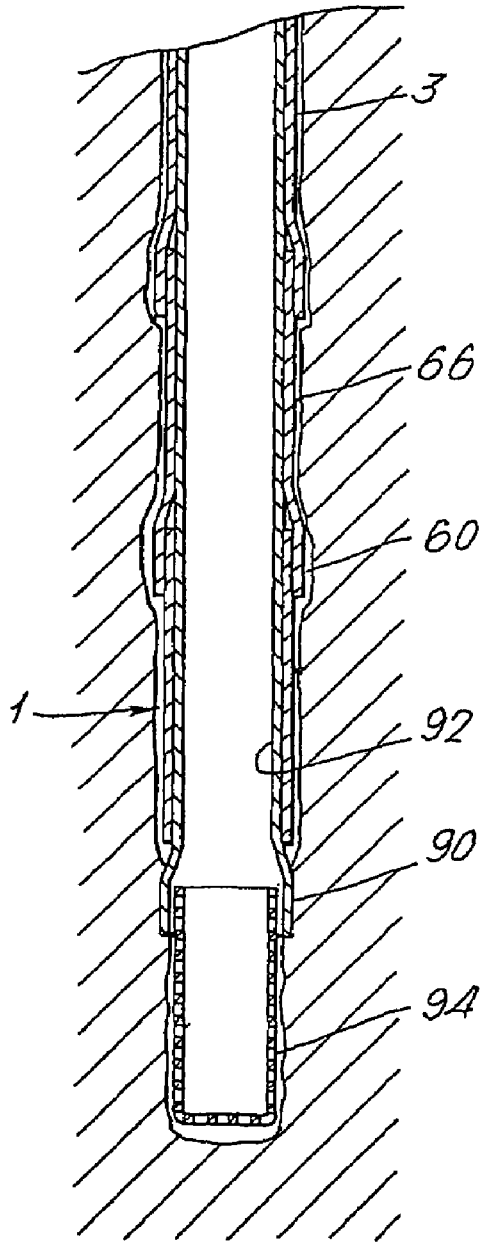
FIG. 22 schematically shows a third possible completion of the borehole after drilling of the borehole as shown in FIGS. 1-18.

The borehole can be completed in various alternative ways, whereby the casing 64 is not retrieved from the borehole, for example:

- as a "bare foot" completion whereby no bell is needed in the lowest expanded tubular element portion, and whereby a final upper tubular element portion 80 is lowered through a final expanded lower tubular element portion 82, whereby the upper tubular element portion 80 is left in the borehole in unexpanded state to form a production string for the production of hydrocarbon fluid, and whereby an expandable production packer 84 is lowered through the tubular element 80 on wireline, and set at the bottom end thereof to seal off the annulus between said tubular element 80 and tubular element portion 82.
- as a "perforated casing" completion whereby no bell is needed in the lowest expanded tubular element portion, and whereby a final upper tubular element portion 84 is lowered through a final expanded lower tubular element portion 86, which upper tubular element portion 84 is expanded throughout its length against the previously installed expanded tubular element portions to form a "clad" production string for the production of hydrocarbon fluid. The lower end part of the final upper tubular element portion 84 is provided with perforations 88 in conventional manner (FIG. 21);
- as a "sandscreen" completion whereby the upper tubular element 92 is expanded against the previously installed expanded tubular element portions, a bell 90 is formed in the lowest expanded tubular element portion 92, and whereby a sandscreen is 94 is arranged below the tubular element portion 92. The sandscreen 94 suitably is radially expanded after installation in the borehole (FIG. 22).

In the above description the surface casing and the tubular element are made of steel, however any other suitable material can be applied for these components.

The upper section of the borehole can be drilled and provided with surface casing in a conventional manner. Alternatively the upper borehole section can be drilled and provided with surface casing in the same manner as described above with reference to the subsequent borehole sections.

Instead of applying the drilling assembly and the expansion assembly, suitably a single assembly having the functionalities of both the drilling assembly and the expansion assembly as described above, can be applied.

Instead of applying a hydraulic motor in the drilling assembly, any other suitable motor for driving the underreamer drill bit and pilot drill bit can be applied, for example an electric motor. Alternatively the drill bit can be rotated by rotation of the tubular element.

Vertical hole sections can be drilled without a steering device in the drilling assembly.

Instead of applying an electric motor in the expansion assembly, any other suitable motor for driving the expander (s) can be applied, for example a hydraulic motor. In such application a conduit for supplying hydraulic power is suitably provided, for example a coiled tubing.

Instead of applying the expanders 46 and 48, suitably a single expander with two extended positions (D1 and D2) can be applied.

Furthermore, instead of expanding the tubular element using the expansion assembly, which alternatingly moves between a radially retracted mode and a radially expanded mode, a conventional expander cone can be pumped or pulled through the tubular element to expand same.

Preferably such expander cone, or the expander(s) referred to above, is collapsible to allow it to pass through the unexpanded tubular element.

Sealing between the expanded tubular element portions and the borehole wall can be achieved by expanding the tubular element portions against the borehole wall. This can be done along the whole length of the borehole, or along selected borehole sections to achieve zonal isolation. Suitably, rubber elements are pre-installed on the outer diameter of the tubular element to assist sealing in hard formations. Such rubber elements can be swellable elements. Alternatively, cement can pumped between the expanded tubular element portions and the borehole wall to achieve sealing.

The expandable tubular element is suitably formed from a plurality of tubular element sections interconnected by welding.

Alternatively the tubular element can be formed of sections interconnected by threaded connections. In such case the upper and lower tubular element portions are suitably separated from each other by unscrewing a selected said threaded connection, for example using a break-out device for unscrewing the selected threaded connection. Preferably such break-out device is provided at the expansion assembly whereby the break-out device replaces the cutter referred to above.

Preferably the fluid pressure in the borehole is controlled using a sealing means around the tubular element at surface, and a pressure control system for controlling the fluid pressure.

We claim:

1. A method of creating a borehole in an earth formation, the method comprising the steps of:

a) drilling a section of the borehole and lowering an expandable tubular element into the borehole whereby a lower portion of the tubular element extends into the drilled borehole section;

b) radially expanding said lower portion of the tubular element so as to form a casing in the drilled borehole section;

c) separating an upper portion of the tubular element from said lower portion so as to allow the separated upper portion to be moved relative to said lower portion; and d) lowering said separated upper portion through the expanded lower portion formed in preceding step (b).

2. The method of claim 1, further comprising repeating at least one of step a), steps a) and b), steps a), b) and c), and steps a), b), c) and d) until the desired borehole depth is reached, whereby:

in each repeated step a) the borehole section is drilled subsequent to the borehole section drilled in the preceding step a), whereby the latter borehole section is defined to be the previous borehole section;

in each repeated step a) the tubular element to be lowered is the upper portion of the tubular element resulting from the preceding step c);

in each repeated step b) the casing is formed subsequent to the casing formed in the preceding step b), whereby the latter casing is defined to be the previous casing.

3. The method of claim 2, wherein in each repeated step c) said upper portion is separated from said lower portion at a position where the tubular element extends into a previous casing arranged in the borehole.

4. The method of claim 3, whereby said previous casing has a lower end part of enlarged inner diameter compared to the remainder of the previous casing, and wherein said upper tubular element portion is separated from said lower tubular element portion at a position where the tubular element extends into said lower end part of the previous casing.

5. The method of claim 1, wherein in step a) the tubular element is lowered into the drilled borehole section simultaneously with drilling of the borehole section.

6. The method of claim 1, wherein in step c) said upper portion is separated from said lower portion by cutting the tubular element, or by unscrewing a threaded connection of the tubular element.

7. The method of claim 6, wherein said upper portion is separated from said lower portion at a location where the tubular element is substantially unexpanded.

8. The method of claim 1, wherein said borehole section is drilled using a drilling assembly that is axially movable through the tubular element, and wherein before step a) the drilling assembly is moved downwardly through the through the tubular element to a position whereby the drilling assembly at least partly extends below the tubular element.

9. The method of claim 8, whereby in said position the drilling assembly is releasably connected to the tubular element, and wherein after drilling the borehole section, the drilling assembly is released from the tubular element and moved upwardly through the tubular element to surface.

10. The method of claim 8, wherein the drilling assembly is moved through the tubular element by means of a wireline extending from surface through the tubular element, to the drilling assembly.

11. The method of claim 1, wherein step b) comprises arranging an expansion assembly in said lower portion of the tubular element, and operating the expansion assembly so as to expand said lower portion.

12. The method of claim 11, whereby the expansion assembly is operable between a radially expanded mode and a radially retracted mode in which the expansion assembly is movable through the tubular element, and wherein the expansion assembly is arranged in said lower portion of the tubular element by moving the expansion assembly downwardly through the tubular element whereby the expansion assembly is in the retracted mode.

13. The method of claim 12 whereby the expansion assembly is arranged to expand the tubular element upon movement of the expansion assembly from the radially retracted mode to the radially expanded mode thereof, wherein the method comprises alternatingly moving the expansion assembly between the radially retracted mode and the radially expanded mode, and wherein the expansion assembly is progressed through the tubular element during periods of time that the expansion assembly is in the retracted mode.

14. The method of claim 12, wherein the expansion assembly is progressed through the tubular element by means of a wireline, a tubular string, or a coiled tubing extending from surface through the tubular element, to the expansion assembly.

15. The method of claim 11, whereby the expansion assembly is operable to selectively expand the tubular element to a first inner diameter and to a second inner diameter larger than the first inner diameter, and wherein the expansion assembly is operated to expand a lower end part of said lower portion of the tubular element to the second inner diameter and to expand the remainder of said lower portion to the first inner diameter.

16. The method of claim 11, whereby the expansion assembly is provided with a cutter for cutting the tubular element or a break-out device for unscrewing a threaded connector of the tubular assembly, and wherein each step c) comprises, after expanding said lower portion of the tubular element operating the cutter to cut the tubular element, or operating the break-out device to unscrew a selected threaded connection of the tubular element, so as to separate said upper portion of the tubular element from said lower portion thereof.

17. The method of claim 16, whereby the cutter or the break-out device is axially spaced upwardly from an expander of the expansion assembly, whereby said lower portion of the tubular element has a substantially unexpanded upper end part, and wherein the cutter is operated to cut the tubular element at said substantially unexpanded upper end part.

18. The method of claim 17, further comprising after cutting the tubular element, or unscrewing the selected threaded connection of the tubular element, further operating the expansion assembly so as to expand said upper end part of the lower portion of the tubular element.

19. The method claim 1, wherein step a) is carried out using a drilling assembly that is sized to allow the assembly to be moved through the tubular element when unexpanded the drilling assembly comprising a drill bit, a downhole motor arranged to drive the drill bit, and movement means for moving the drilling assembly through the tubular element, wherein said movement means comprises a connection member for connecting a wireline extending from surface through the tubular element, to the drilling assembly, wherein the drilling assembly further comprises anchoring means for anchoring the drilling assembly in the tubular element such that the drilling assembly at least partly extends below the tubular element, and wherein the anchoring means is adapted to anchor the drilling assembly in an upper portion of the tubular element after separating said upper portion from a lower portion of the tubular element.

20. The method of claim 19, wherein the drilling assembly is located in the tubular element, and wherein a wireline extending from surface through the tubular element, is connected to said connection member.

21. The method of claim 19, wherein the anchoring means is radially retractable so as to release the drilling assembly from the tubular element upon radial retraction of the anchoring means.

22. The method of claim 1, wherein step b) is carried out using an expansion assembly that is:

operable between a radially expanded mode in which the expansion assembly has a diameter larger than the inner diameter of the tubular element when unexpanded and a radially retracted mode in which the expansion assembly has a diameter smaller than the inner diameter of the tubular element when unexpanded, and wherein the expansion assembly comprises actuating means arranged to move the expansion assembly from the radially retracted mode to the radially expanded mode thereby expanding the tubular element when the expansion assembly is positioned in the tubular element, wherein the expansion assembly further comprises progressing means for axially progressing the expansion assembly through the tubular element, the progressing means comprising a connector member for connecting a wireline extending from surface through the tubular element, to the expansion assembly.

23. The method of claim 22, wherein the expansion assembly is located in the tubular element, and wherein a wireline extending from surface through the tubular element, is connected to said connector member of the expansion assembly.

24. The method of claim 22, wherein the expansion assembly is selectively operable to expand the tubular element to a first inner diameter and to a second inner diameter larger than the first inner diameter.

25. The method of claim 22, comprising a cutter for cutting the tubular element.

26. The method of claim 25, whereby the cutter is axially spaced upwardly from an expander of the expansion assembly.

* * * * *